United States Patent [19]

Sirhan

[11] Patent Number: 4,903,864

[45] Date of Patent: Feb. 27, 1990

[54] GLOVE AMUSEMENT DEVICE

[76] Inventor: Eddie A. Sirhan, 2410 Olympic Dr., South San Francisco, Calif. 94080

[21] Appl. No.: 206,574

[22] Filed: Jun. 14, 1988

[51] Int. Cl.[4] ..... B67D 5/64

[52] U.S. Cl. ..... 222/78; 2/160; 222/175; 222/192; 222/333; 239/154; 239/332; 239/529; 446/26; 446/473; 446/475

[58] Field of Search ..... 222/78, 79, 175, 192, 222/333; 239/152–154, 332, 529; 2/16, 159, 160, 162, 168, 170; 4/615; 42/1.11, 54; 272/27 W; 439/37; 446/26, 473, 475, 483; 109/29, 32

[56] References Cited

U.S. PATENT DOCUMENTS

| | | | |
|---|---|---|---|
| 836,181 | 11/1906 | Cray . | |
| 1,177,412 | 3/1916 | Hopkins | 239/529 |
| 1,534,208 | 4/1925 | Gibson | 239/529 X |
| 1,558,930 | 10/1925 | Schuck | 239/529 |
| 2,192,082 | 2/1940 | Hunicke | 222/175 |
| 3,726,443 | 4/1973 | Harris | 222/333 |
| 4,037,790 | 7/1977 | Reiser et al. | 222/175 X |
| 4,139,130 | 2/1979 | Glusker et al. | 222/175 X |
| 4,214,674 | 7/1980 | Jones et al. | 222/79 |
| 4,407,454 | 10/1983 | Massey | 239/154 |
| 4,526,298 | 7/1985 | Boxer et al. | 222/175 X |
| 4,621,770 | 11/1986 | Sayen | 239/332 X |
| 4,750,641 | 6/1988 | Chin-Fu | 222/79 |
| 4,768,681 | 9/1988 | Dean et al. | 222/79 |

*Primary Examiner*—Kevin P. Shaver
*Attorney, Agent, or Firm*—Douglas A. Chaikin

[57] ABSTRACT

Disclosed herein is a glove amusement device for squirting liquid. The device includes a liquid storage apparatus, a glove and an umbilical cord connecting the two. The liquid storage apparatus includes an electromechanical pump which is activated by a trigger mechanism on the glove and a liquid container. The umbilical cord contains both electrical and liquid conduit. The electrical conduit connects the pump and the trigger and a portable power source, such as a battery pack, while the liquid conduit connects the liquid container and an opening in the glove. The liquid is transported from the container through the liquid conduit out an opening in the glove by activation of a pump. An end cap at the termination of the liquid conduit causes pressure to build at the end cap and a pulsating, hard stream of liquid is forced out the glove opening.

18 Claims, 2 Drawing Sheets

GLOVE AMUSEMENT DEVICE

BACKGROUND OF THE INVENTION

1. Field of the Invention

This invention relates to amusement devices and more particularly to amusements devices for squirting liquids.

2. Previous Art

No water amusement device is known which employs a glove and a portable water storage and power assembly. Previous water amusement devices have included a replica of virtually every known gun, including pistols, M-16's, 9 MM automatic hand guns and Uzzi's. Some of these replicas are so realistic, they have been mistaken for real guns. In some isolated incidents, these mistakes have caused fatal results. In fact many police departments throughout the United States have lobbied and been effective at having legislation passed which bans such realistic gun replicas.

The replica water guns are typically made from a hard, high impact plastic to promote durability and to add to their appearance. Unfortunately, this same hard, high impact plastic has some serious disadvantages. In the heat of a water competition, participants may be accidentally struck with the replica guns made from this hard, high, impact plastic causing harm and even serious injury. Such replica water guns typically have a separate small water storage and an electro-mechanical pump to pump the water from the storage to the gun opening. A portable power source is also typically provided with the replica water guns to run the pump. A trigger is also typically provided for activating the pump. None of the replica water guns have the structure or advantages of a glove- like device.

The closest reference found is to the invention herein is to Reiser et al, U.S. Pat. No. 4,037,790 which discloses a glove for expelling liquid for the wrist area by applying pressure to the palm portion. The Reiser et al glove has a compressible bulb disposed at the palm portion of the glove. A tube extends into an aperture on the glove for spraying. The Reiser et al structure has no separate portable water source and must be refilled after the bulb runs out of liquid. This lack of a separable water storage is especially important in organized water competitions. Running out of water frequently adds to the likelihood of a participant become water soaked. Being able to squirt other participants is both a defensive and an offensive tool. Additionally, Reiser et al does not disclose an electro-mechanical power source.

Others have developed water gloves for watering and gardening not suitable for being an amusement device. For example, Gibson, U.S. Pat. No. 1,534,208; Cray, U.S. Pat. No. 836,181; and Hopkins, U.S. Pat. No. 1,177,412 all disclose watering gloves which are suitable for gardening and not for water competitions. Particularly, Cray and Gibson disclose the use of the use of stop cocks which are slow and difficult to open and close quickly; an absolute necessity in water competitions. Additionally, none of the above reference disclose a separate water storage or portable power source. While the replica water guns do offer the advantage of water flowing in a hard, pulsating stream, the disadvantages noted above are present. The watering gloves referred to above disclose the use of a glove for gardening and amusement. However, these gloves are unsuitable for organized water competitions because they are slow to operate (open and close) and have neither a separable water storage nor a power source for squirting the water. What is needed is a water amusement device which has the advantage of flowing water in a hard, pulsating stream without the disadvantages of being mistaken for a real gun or causing injury during the heat of a water competition due to the high impact plastic structure of the replica water gun.

SUMMARY OF THE INVENTION

It is an object of this invention to provide an amusement device for squirting liquids which may be used for organized water competitions.

It is a further object of this invention to provide a safe and effective glove amusement device which squirts water in a hard, pulsating stream and which will not injure participants in organized water competitions even in the heat of said competition.

It is a further object of this invention to provide a water glove amusement device which has a separable water storage and power apparatus.

In accordance with the above objects and those that will be mentioned and will become apparent below, the glove amusement device in accordance this invention, comprises:

separable storage means for storing liquid including pump means for pumping liquid from the storage means;

a glove having an opening for squirting liquid and trigger means for activating the pump means; and umbilical cord means connecting the storage means and the glove opening for transporting liquid from the storage means to the glove opening, thereby, upon activation of the pump means the liquid is transported to the glove opening and squirted therethrough.

A second embodiment of the glove amusement device comprises:

storage means for storing liquid including pump means for pumping liquid from the storage means;

a glove having an opening for squirting liquid and trigger means for activating the pump means, the opening and the trigger means being located on different glove fingers; and umbilical cord means connecting the storage means and the glove opening for transporting liquid from the storage means to the glove opening, thereby, upon activation of the pump means the liquid is transported-to the glove opening and squirted therethrough.

Other features of the preferred embodiment of the instant invention include the liquid storage means having a container which has two vents, an input vent and an atmospheric vent. The input vent is threaded and sealed by an enlarged, knurled, threaded knob. The atmospheric vent is seal by a plug and during refilling is removed to facilitate rapid and easy refill.

Also in the preferred embodiment the glove is a skin diver's type glove and the umbilical cord includes a male velcro strip suitable for attachment the user's clothing.

It is an advantage of this invention to provide a glove amusement device which is suitable for use in organized water competitions.

It is an additional advantage of this invention to provide a safe and effective water glove amusement device.

BRIEF DESCRIPTION OF THE DRAWING

For a further understanding of the objects and advantages of the present invention, reference should be had to the following detailed description, taken in conjunction with the accompanying drawing, wherein.

DETAILED DESCRIPTION OF THE INVENTION

Figure 1:
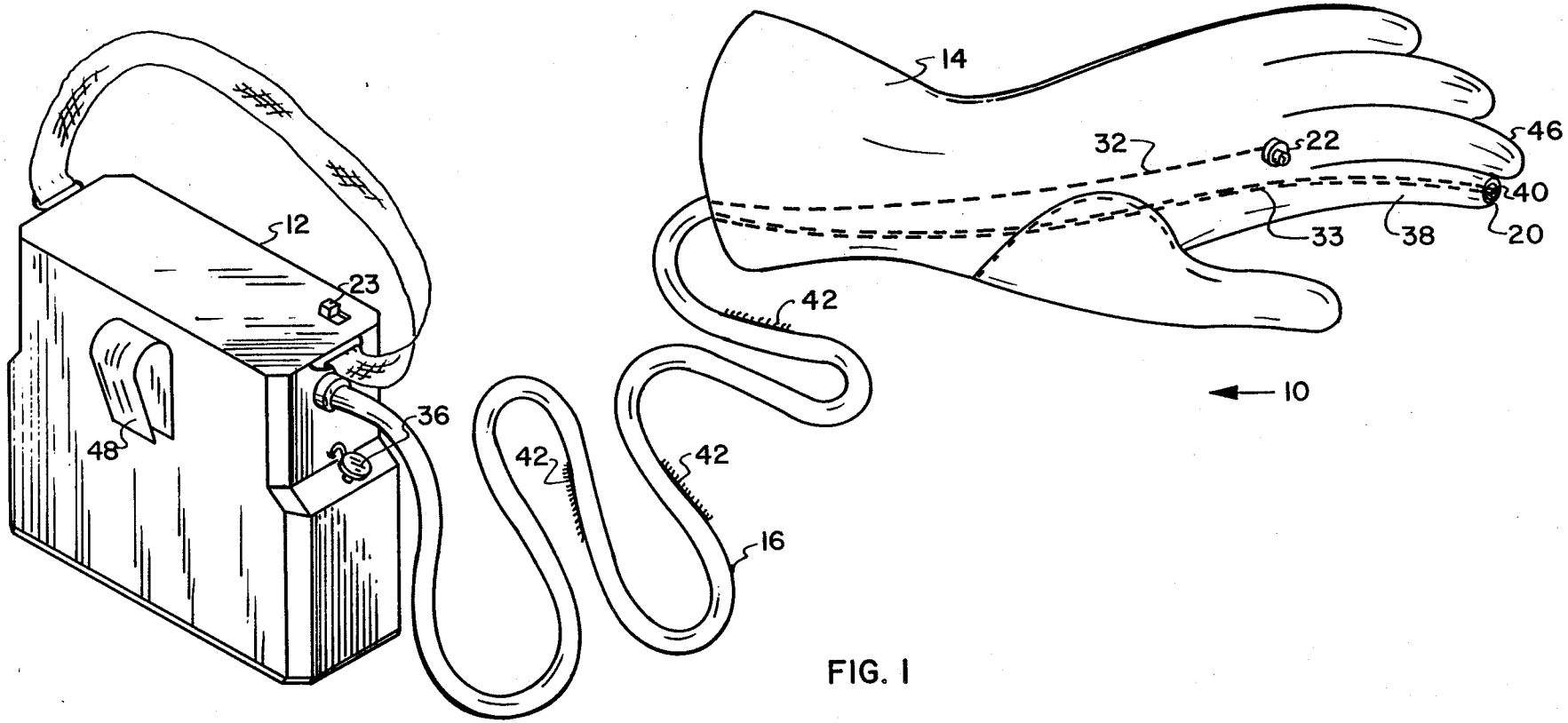
FIG. 1 is a perspective view of the glove amusement device in accordance with this invention.

The invention will now be described with respect to the drawing wherein like reference characters designate like or corresponding parts throughout the several views. Referring particularly to FIG. 1, there is shown the invention, a glove amusement device for squirting water, generally indicated by the numeral 10.

The glove amusement device 10 includes a water storage apparatus 12, a glove 14 and an umbilical cord 16 connecting the water storage apparatus 12 and the glove 14. As shown in schematic in FIG. 3, water from the water storage apparatus 12 is pumped by pump 18 through the umbilical cord 16 to an opening 20 in the glove 14. The pump 18 is activated by a normally open momentary switch which defines a trigger mechanism 22 when an on/off switch 23 (FIG. 1) is turned on.

Figure 2:
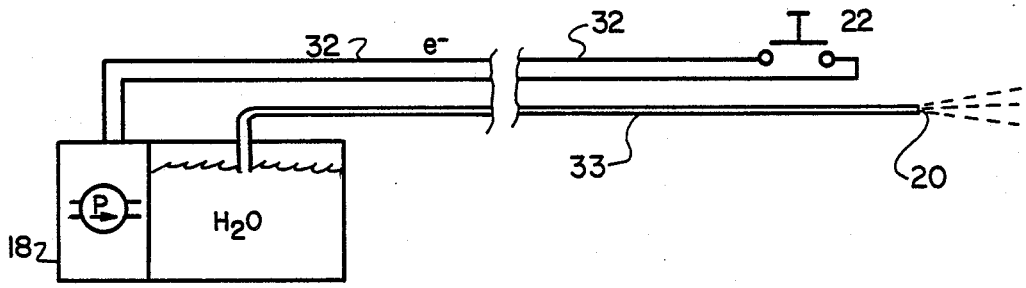
FIG. 2 is a schematic view of the trigger mechanism and the electro-mechanical pump and the water storage container.
Figure 3:
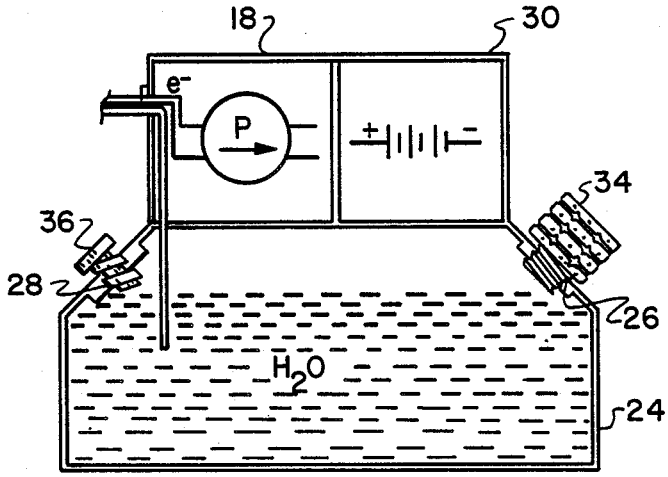
FIG. 3 is a schematic view of the glove amusement device in accordance with this invention illustrating the electro-mechanical pump and a detailed view of the water storage container.

With particular reference to FIGS. 2 and 3, there is shown the detailed structure of the pump 18. The water storage apparatus 12 includes a container 24 which is filled with water by pouring water through input vent 26. The container 24 is preferably made of high impact plastic. The input vent 26 is threaded for convenient access and to ensure minimum leakage and spillage from the container 24. Filling water into the container 24 is facilitated by opening atmospheric vent 28.

As pointed out earlier, during a water competition, speed and ease of refilling a participant's water device is vital. In order to facilitate the speed and ease of refilling the container 24, an enlarged, knurled knob 34 with a threaded end is used to seal the input vent 26. The threaded end of the knob 34 is compatible with the threaded vent 26 for making the sealed closing of the vent 26. The atmospheric vent 28 is sealed by slip-in plug 36. Plug 36 is relatively loosely fit into opening 28 from easy access.

As shown in FIG. 1, the container 24 includes a belt clip 48 for attaching the water storage apparatus 12 to the belt of a user.

Using this structure, the water storage apparatus 12 is not an obstacle or an impediment to the user's movements. Additionally, even though the container 24 is made from hard, high impact plastic, it is unlikely to cause injury to water competition participants since the container 24 is attached to the belt of a user and away from the fragile areas of the bodies of the participants.

The pump 18 is a portable electro-mechanical device which is powered by a battery pack 30, comprising four (4) "D" cell batteries. Electrical conduit 32 connects the battery pack 30, the trigger mechanism 22 and the pump 18. Depressing the trigger mechanism 22 completes the circuit shown in FIG. 2, which activates the pump 18. Water is pumped from water storage 12 through a water conduit 33 to the opening 20 of the glove 14. The electrical conduit 32 and the water conduit 33 are bundled together in the umbilical cord 16. The pump 18 pumps water (or other liquids) at the rate of 250 ml per minute when the battery pack 30 is fully charged.

The glove 14 as shown in FIG. 1 is a form fitting glove and similar in structure to and made from the same material as a diver's glove. The water conduit 33 terminates at one of the extremities of a finger 38 of the glove 14. An end cap 40 having a small opening is fitted to the termination of the umbilical cord 16. The outside diameter of the end cap 40 is sized and shaped to permit the end cap 40 to fit matingly into the glove opening 20. The end cap 40 has a pin hole opening in the center for building pressure of the water and for directing the hard, pulsating stream. While it is the index finger 38 of the glove 14 which is shown as having the opening 20, it will be appreciated that any extremity of the glove 14 having the opening 20 will be within the scope of this invention.

The water conduit 33 is made of a sterile engineering plastic having a diameter in cross-section of "d". The water conduit 33 may be several feet in length and should be pliable so that it is not uncomfortable for the user to wrap around himself and move about. To facilitate this convenience and to add comfort and convenience to the user, a series of a male velcro strips 42 are attached to the umbilical cord 16. The male velcro strip 42 easily attaches itself to a user's clothing so that when moving about during a water competition, the umbilical cord 16 does not become an obstacle.

Figure 4:
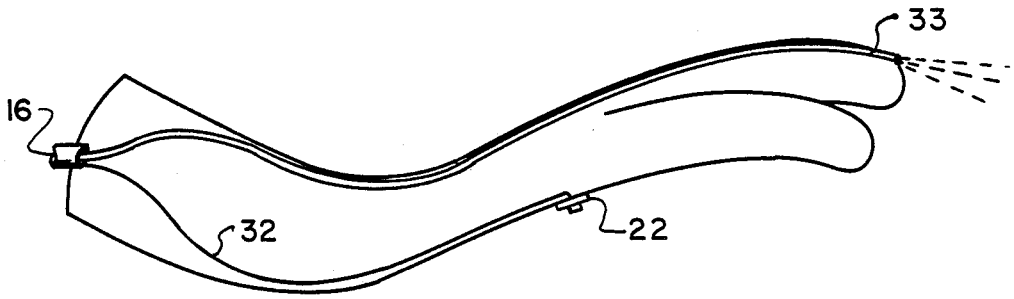
FIG. 4 is a partial cross-sectional view of the glove amusement device in accordance with this invention illustrating a finger of the glove having the trigger mechanism and a separate finger having the glove opening.

With particular reference to FIG. 4, there is shown a detailed view of the index glove finger 38. The umbilical cord 16 terminates at the finger 38. The electrical conduit 32 is attached to the trigger 22 where it may be depressed with one quick, simple squeezing motion of the middle finger 46 activating the pump. This motion is similar to the motion of squeezing the trigger of a gun, except the middle finger is used instead of the index finger. The index finger 38 of the glove 14 is pointed in the direction of the target.

The diameter of the pin hole opening in the end cap 40 is many times smaller than the diameter "d" of the cross-section of the water conduit 32. As the pump 18 forces water through the water conduit, pressure builds at the end cap 40 causing a hard, pulsating stream of water to burst through the opening 20 toward the target. The diameter of the opening in the end cap is 0.030" and is no greater than "d"/420 and preferably between "d"/500 TO "d"/1,000.

While the foregoing detailed description has described only one embodiment of the a glove amusement device in accordance with this invention, it is to be understood that the above description is illustrative only and not limiting of the disclosed invention. Particularly, other embodiments are possible. Notably, the trigger mechanism 22 may be on any of the fingers of the glove 14. Likewise the opening 24 in the glove 14 for squirting water may be on any extremity of the glove. It will be appreciated that any combination of fingers for the trigger mechanism 22 and glove opening 24 is also within the scope and spirit of this invention. Thus the invention is to be limited only by the claims as set forth below.

What is claimed is:

1. A glove amusement device for squirting liquid, comprising:

separable storage means for storing liquid including pump means for pumping liquid from the storage means;

a glove having an opening for squirting liquid and trigger means for activating the pump means; and umbilical cord means connecting the storage means and the glove opening for transporting liquid from the storage means to the glove opening, thereby, upon activation of the pump means the liquid is transported to the glove opening and squirted therethrough.

2. A glove amusement device for squirting liquid as set forth in claim 1, wherein the glove opening is located on an extremity of a finger of the glove.

3. A glove amusement device for squirting liquid as set forth in claim 1, wherein the pump means comprises an electro-mechanical pump and wherein the device includes portable electrical means for powering the pump.

4. A glove amusement device for squirting liquid as set forth in claim 3, wherein portable electrical means comprises a battery pack.

5. A glove amusement device for squirting liquid as set forth in claim 4, wherein electrical wires connect the pump, the battery means and the trigger means.

6. A glove amusement device for squirting liquid as set forth in claim 1, wherein the liquid conduit connects the liquid storage means and the opening of the glove and wherein electrical conduit connects the pump, the battery means and the trigger means, and wherein the umbilical cord means bundles the liquid conduit and the electrical conduit from the liquid storage means to the glove.

7. A glove amusement device for squirting liquid as set forth in claim 6, wherein the liquid conduit comprises a tube made from sterile engineering plastic having a predetermined diameter "d".

8. A glove amusement device for squirting liquid as set forth in claim 1, wherein the tube has an end cap having a pin hole opening which mates compatibly with the opening in the glove and which builds pressure when the pump is activated for causing a hard, pulsating stream of liquid to flow.

9. A glove amusement device for squirting liquid as set forth in claim 8 wherein the pin hole opening has a diameter of no greater than "d"/420.

10. A glove amusement device for squirting liquid as set forth in claim 1, wherein the storage means holds 1 quart of liquid.

11. A glove amusement device for squirting liquid as set forth in claim 1, wherein the storage means comprises a container having 2 vents, an input vent for filling up the storage means and an atmospheric vent for easy and rapid filling of the storage means.

12. A glove amusement device for squirting liquid as set forth in claim 1, wherein the input vent includes a enlarged, knurled knob for easy and rapid opening and closing if the input vent.

13. A glove amusement device for squirting liquid as set forth in claim wherein the storage means includes a belt clip for attachment to the user.

14. A glove amusement device for squirting liquid as set forth in claim 1, wherein umbilical cord means includes means for attaching the umbilical cord means to the clothes of the user.

15. A glove amusement device for squirting liquid as set forth in claim 14, wherein the means for attaching comprises male velcro.

16. A glove amusement device for squirting water as set forth in claim 1, wherein the container is made from hard, high impact plastic.

17. An integrated glove amusement device for squirting liquid, comprising:

storage means for storing liquid including pump means for pumping liquid from the storage means;

a closed fingered glove having an opening for squirting liquid and trigger means for activating the pump means, the trigger means being located on one finger of the glove and being activated by squeezing motion of said finger of the glove and the opening and the trigger means being located on different glove fingers; and umbilical cord means connecting the storage means and the glove opening for transporting liquid from the storage means to the glove opening, thereby, upon activation of the pump means the liquid is transported to the glove opening and squirted therethrough.

18. A glove amusement device for squirting liquid, comprising:

storage means for storing liquid including pump means for pumping liquid from the storage means;

a glove having an opening for squirting liquid and trigger means for activating the pump means, the trigger means being located immediately adjacent to one and only one of the glove fingers and being activating by squeezing motions of said finger of the glove and the opening and the trigger means being located on different glove fingers; and umbilical cord means connecting the storage means and the glove opening for transporting liquid from the storage means to the glove opening, thereby, upon activation of the pump means the liquid is transported to the glove opening and squirted therethrough.

* * * * *